United States Patent [19]

Fichter et al.

[11] Patent Number: 4,824,096

[45] Date of Patent: Apr. 25, 1989

[54] SHEET CLAMP COUNTERBALANCING SYSTEM FOR HIGH SPEED SHEET HANDLING DRUMS

[75] Inventors: June C. Fichter, Canton; Theodore J. LaBelle, Dorchester; Kenneth A. McAuley, Boston, all of Mass.

[73] Assignee: Polaroid Corporation, Cambridge, Mass.

[21] Appl. No.: 74,688

[22] Filed: Jul. 17, 1987

[51] Int. Cl.[4] ..... B65H 5/12

[52] U.S. Cl. ..... 271/277; 271/82; 101/410

[58] Field of Search ..... 346/138; 271/276, 277, 271/268, 82, 204–206; 101/409–412, 415.1

[56] References Cited

U.S. PATENT DOCUMENTS

| | | | |
|---|---|---|---|
| 879,504 | 2/1908 | Wattles . | |
| 967,592 | 8/1910 | Wattles . | |
| 1,721,172 | 7/1929 | Becker . | |
| 2,046,122 | 6/1936 | Hunt | 51/194 |
| 2,622,000 | 12/1952 | Thompson | 346/138 |
| 3,618,123 | 11/1971 | Buddendeck | 346/138 |
| 3,654,624 | 4/1972 | Becker et al. | 340/173 LM |
| 3,843,114 | 10/1974 | Kojima et al. | 271/3 |
| 3,903,795 | 9/1975 | Suzuki | 101/409 |
| 4,110,882 | 9/1978 | Hodge et al. | 29/118 |
| 4,111,119 | 9/1978 | Takizawa et al. | 101/127.1 |
| 4,134,136 | 1/1979 | Costello et al. | 358/291 |
| 4,183,652 | 1/1980 | Yanagawa | 355/3 DR |
| 4,250,810 | 2/1981 | Fowler et al. | 101/410 |
| 4,390,176 | 6/1983 | Kato | 101/411 |
| 4,517,575 | 5/1985 | Kakimoto et al. | 346/138 |
| 4,660,825 | 4/1987 | Umezawa | 271/276 |

*Primary Examiner*—H. Grant Skaggs

*Attorney, Agent, or Firm*—Robert L. Berger; Robert F. Ziems; Karl Hormann

[57] ABSTRACT

A counterbalancing and sheet clamp retention system for high speed sheet handling drums of the type in which leading and trailing edge clamping bars extend along the length of the drum periphery and are capable of movement between retracted and sheet clamping positions for automatic loading and unloading successive sheets to and from the drum. The clamping bars, supported at opposite ends for movement between their respective retracted and clamping positions, are engaged centrally along their length by a retaining device which moves to a clamping bar engaging position under centrifugal force as the rotational velocity of the drum reaches a predetermined value. The retaining device is a self-contained unit insertable through a radial opening in the drum and contains a pair of bell crank retainers each having a clamping bar engaging claw on one arm and a weight on the other arm so that centrifugal force operates to pivot the bell crank and bring the claws thereon into engagement with the closed sheet clamping bars. The drum is further counterbalanced by a fixed weight opposite from the movable bell crank weights. Further, the ends of the clamping bar are moved against the drum periphery to their sheet clamping positions by centrifugal force acting on counterbalancing weight carried by radially movable brackets from which the ends of the respective clamping bars are supported.

16 Claims, 3 Drawing Sheets

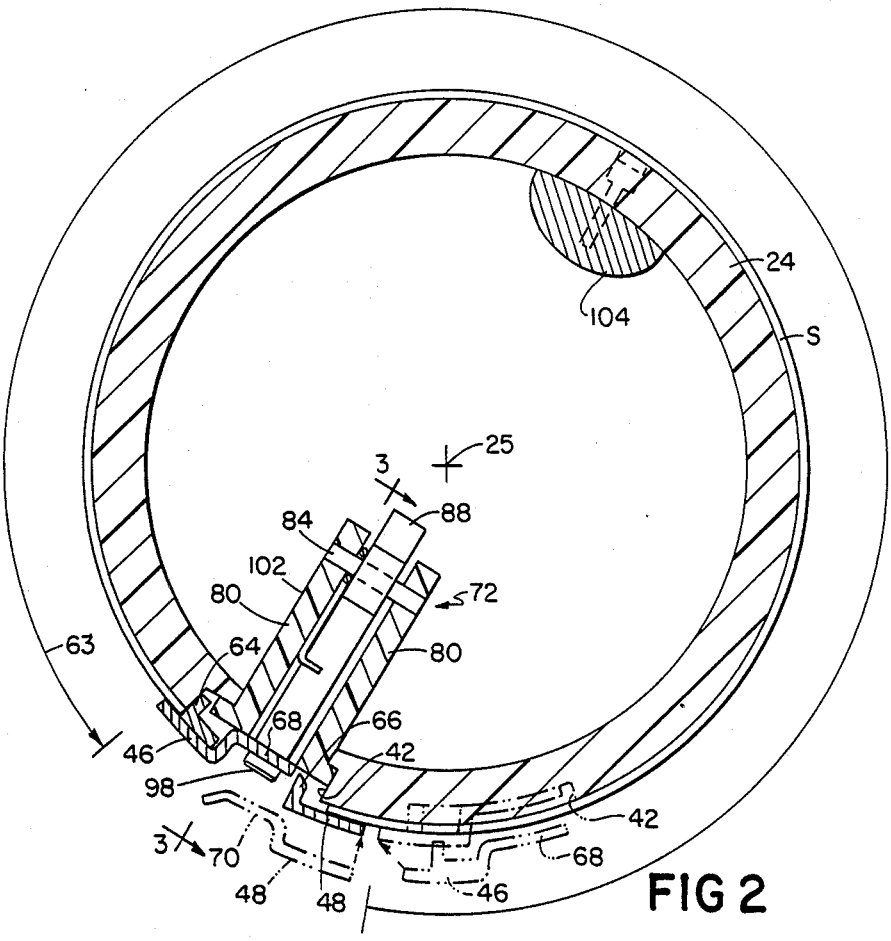
FIG 2
FIG 3
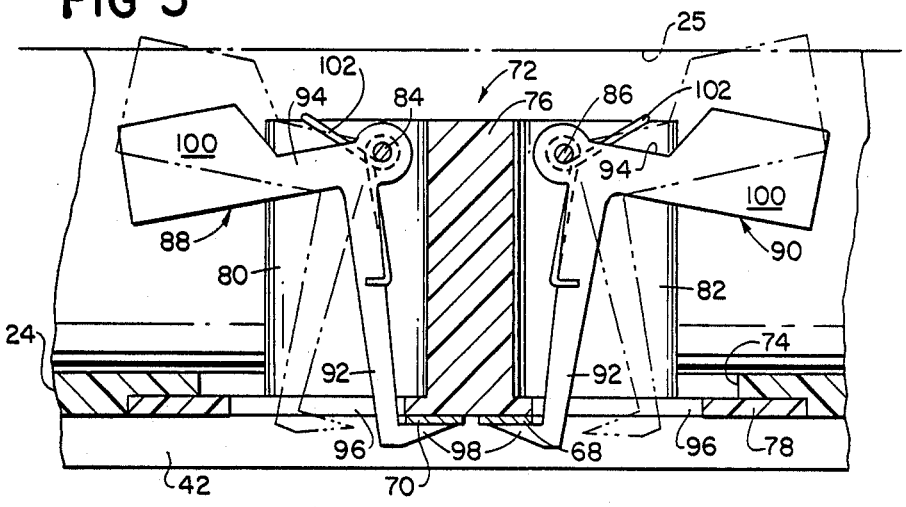

SHEET CLAMP COUNTERBALANCING SYSTEM FOR HIGH SPEED SHEET HANDLING DRUMS

BACKGROUND OF THE INVENTION

This invention relates to improvements in sheet clamping arrangements for high speed sheet handling drums and, more particularly, it concerns a counterbalancing system by which sheet clamping bars are effectively retained against displacement by centrifugal force during retention of a sheet on a rotatable drum for the performance of high speed printing operations.

In a commonly assigned, copending U.S. patent application Ser. No. 034,665, filed Apr. 6, 1987, an improved sheet clamping system for rotatable drums is disclosed by which the leading edge of each of a succession of sheets to the drum periphery is engaged and clamped in position by a leading edge clamping bar rotatable at all times with the drum, the sheet is drawn past a trailing edge clamping bar capable of retention in a fixed retracted position during drum rotation, the trailing edge of the sheet is engaged by the trailing edge clamping bar for continued rotation with the drum for a printing operation, for example, the sheet is discharged from the drum by the trailing edge clamp and the drum and both clamps are subsequently indexed to receive another sheet. The clamping system disclosed in the copending application features a cam actuating mechanism by which both of the clamping bars are moved between sheet clamping and sheet releasing or retracted positions without interference with use of the drum during rotation thereof for printing or other operations on the drum retained sheet.

The capability of the system disclosed in the aforementioned copending application for sheet loading and unloading operations as well as for accurate indexing of a drum mounted sheet with a printing head, for example, has been demonstrated by testing to a point where the drum system has been established as a candidate for a sheet media carrier for high speed laser reproduction of continuous tone images. In this application, the sheet media, after having been mounted to the rotatable drum, is moved at high speeds in relation to a laser printing head to which digital information is supplied and which is traversed axially of the drum to develop closely pitched spiral recording tracks in the production of a high resolution tonal image on the drum retained sheet. In this type of operation, the drum may be rotated at speeds up to 1600 revolutions per minute during the printing operation and then slowed to very low stepping motor speeds for sheet loading and unloading operations. Also in this type of printing operation, because resolution of the tonal image produced is dependent in substantial measure on proximity of the laser printing head to the drum carried media, the spacing between the drum periphery and the head must be kept as small as possible.

As disclosed in the aforementioned copending Application, the two clamping bars by which a sheet is retained to the drum are supported at their ends by brackets movable in a generally radial direction with respect to the drum axis between retracted and sheet clamping positions. The clamping bars, as thus disclosed, are unsupported except at their ends. As a result of the unsupported length of the clamping bars, at rotational speeds substantially less than 1600 revolutions per minute, centrifugal force acting on the clamping bars tends to cause them to bow outwardly away from the drum periphery. While the ends of the bars may be effective to retain the mounted sheet to the drum periphery, outward movement of the bars creates a problem of interference with a printing head in close proximity to the drum periphery. In addition, the cam actuating system of the sheet handling drum disclosed in the aforementioned copending application is dependent on a clamping action developed by spring force.

Because the clamping bars represent a mass eccentric with respect to the drum axis, two major problems are presented during high speed operation. Firstly, the eccentric mass of the clamping bars operates against spring developed clamped retention force so that the clamping action of the bars against the leading and trailing edges of a mounted sheet is reduced proportionally with rotational speed. Secondly, the eccentric mass of the clamping bars, though relatively acceptable at low speed operation, develop intolerable vibrations at speeds of the class encountered in laser reproduction of tonal images.

There is, therefore, a need for improvement in the clamping system of the type referred to for adaptation of that system to operation at rotational velocities approaching or exceeding 1600 revolutions per minute.

SUMMARY OF THE INVENTION

In accordance with the present invention, a rotatable drum sheet clamping system of the type in which leading and trailing edge clamping bars extend along the length of a drum periphery and are capable of loading and unloading successive sheet form media at low speed operation of the drum, is adapted for high speed operation by a counterbalancing system effective to nullify the adverse effects of centrifugal force as well as to provide vibration free operation of the drum at extremely high rotational velocities. The tendency heretofore encountered for the end supported clamping bars to bow outwardly under centrifugal force at high rotational speeds is overcome by the provision of a centrifugally actuated clamping bar retaining device mounted entirely within the drum interior and effective, at drum rotational speeds in excess of the relatively low speeds incurred during sheet loading and unloading operation, to engage and retain the central region of both bars firmly against the drum periphery intermediate the ends thereof.

In a preferred embodiment, the clamping bar retaining device includes a pair of bell-crank shaped retainers pivotally supported from a retainer block insert receivable in the drum interior. One arm of each retainer extends in a generally radial orientation with respect to the drum and carries a foot-like claw for releasably engaging a circumferentially extending tab on the clamping bar to be secured by the respective retainers. The other arm of each retainer carries a weight displaced axially from the retainer pivot. Each retainer is spring biased in a manner to displace the weight toward the drum axis and position the claw thereof in a retracted or inoperative position. Thus, upon rotation of the drum in excess of a speed required for centrifugal force to overcome the spring bias, the claws engage and retain the clamping bar attached tabs.

The clamping bar actuating brackets are further provided with fixed counterweights on the ends thereof opposite from the ends on which the clamping bars are mounted so that as drum rotational speeds increase, the bracket weights operate to pull the clamping bars against the drum periphery under centrifugal force. Dynamic balancing is effected by a combination of the central clamping bar retaining device, the bracket counterbalancing weights and further counterbalancing weights secured within the drum.

A principal object of the present invention, therefore is the provision of a sheet clamping system for a high speed sheet handling drum in which leading and trailing sheet clamping bars extending the length of the drum are supported along the length thereof against displacement from centrifugal force. Another object of the invention is to provide such a clamping system in which the effect of centrifugal force on development of sheet clamping force is neutralized. A still further object of the invention is the provision of such a sheet handling drum which is dynamically balanced and capable of rotation at high speeds without vibration. Other objects and further scope of applicability of the present invention will become apparent from the description to follow taken in conjunction with the accompanying drawings in which like parts are designated by the same reference characters.

BRIEF DESCRIPTION OF THE DRAWINGS

FIG. 2 is a radial cross section of a sheet handling drum incorporating the invention;

FIG. 3 is a fragmentary cross section on line 3—3 of FIG. 2; and

DETAILED DESCRIPTION OF THE PREFERRED EMBODIMENT

Figure 1:
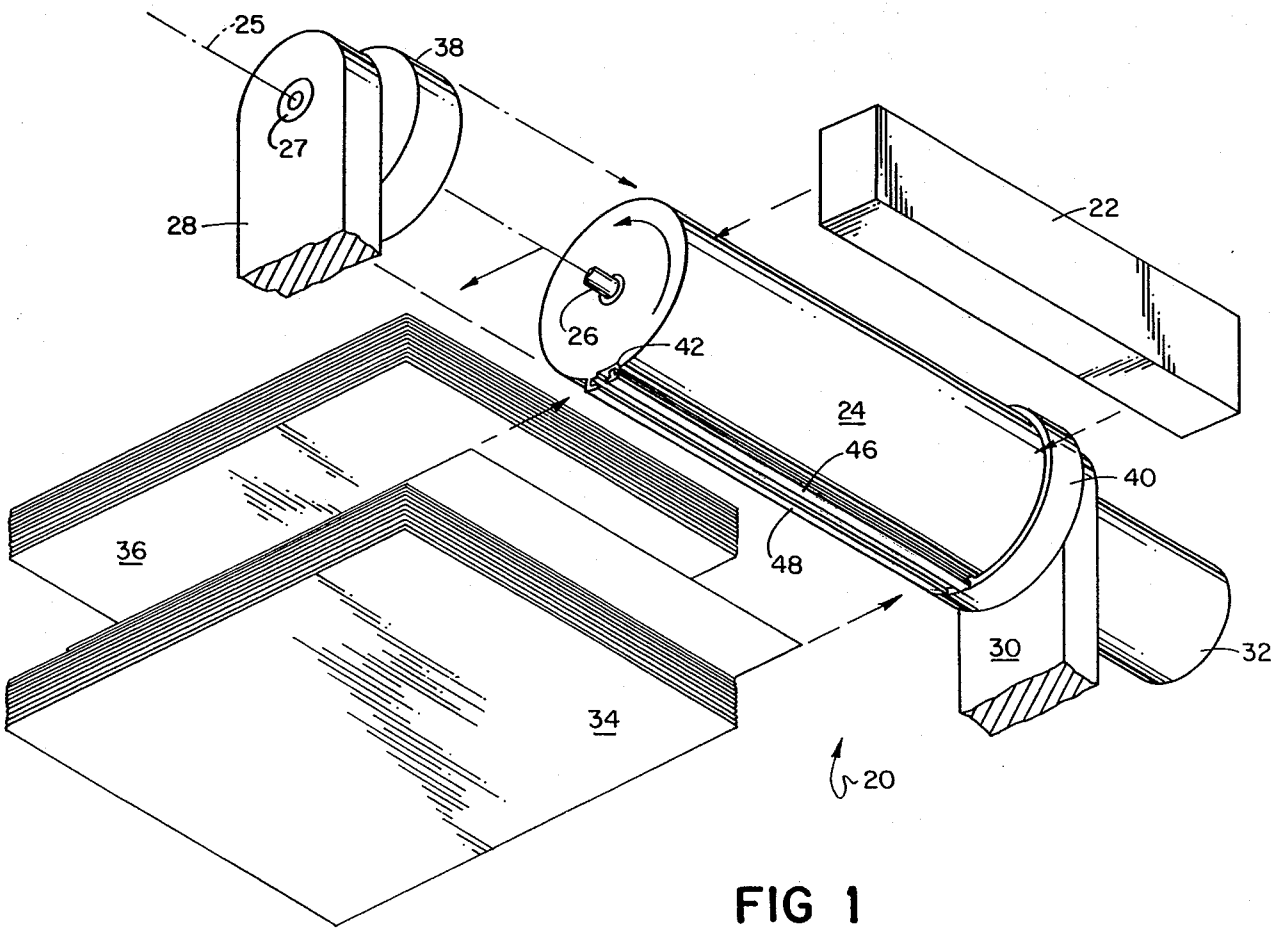
FIG. 1 is a largely schematic, exploded perspective view of a sheet handling apparatus in which the present invention is used.

In FIG. 1 of the drawings, the general organization of a printer incorporating the drum clamping system disclosed in copending application Ser. No. 034,665 is shown to facilitate an understanding of the environment of the present invention. Thus, in FIG. 1, the reference numeral 20 generally designates a printer including a print head assembly 22, a sheet retaining drum 24 supported for rotation on a central axis 25 by a shaft 26 journalled by bearings 27 in axially spaced supports 28 and 30, and a drive motor 32 carried by the support 30. A supply stack 34 of sheets to be printed is shown positioned under a delivery stack 36 of the same sheets after printing. Obviously the stacks 34 and 30 will be supported in trays or the equivalent of trays which are not shown in the interest of clarity.

Also as disclosed in the aforementioned copending Application, the drum is positioned between a pair of end caps 38 and 40 supported by the shaft 26 to be coaxial with the drum 24 but rotatable independently of the drum 24 on the shaft 26. Also, the drum 24 is provided with an axial slot 42 in its cylindrical surface. A leading edge clamping bar 46 is positioned at the radial plane of one edge of the slot 42 whereas a trailing edge clamping bar 48, though positionable independently of the drum when retracted as shown in FIG. 1, is positioned when moved to its sheet clamping position near the opposite edge of the slot 42. The bars 46 and 48 are parts of a sheet clamping system by which a sheet fed from the supply stack 34 may be clamped at its leading and trailing edges about the periphery of the drum 24.

Figure 4:
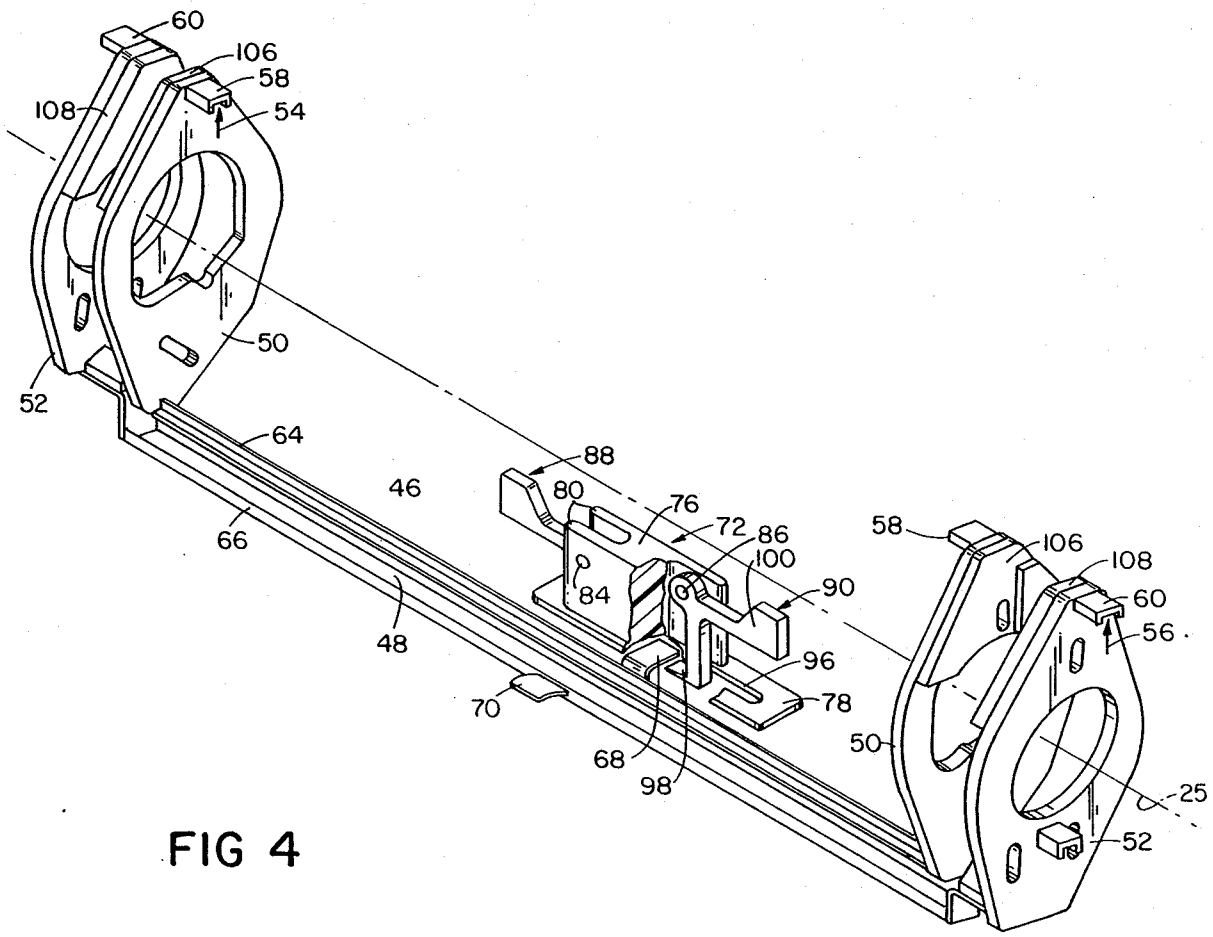
FIG. 4 is a perspective view of the sheet clamping mechanism of the invention.

Movement of the clamping bars 46 and 48 between their respective retracted and closed or clamping positions is effected by the support of each bar at opposite ends by pairs of brackets 50 and 52, respectively, as shown in FIG. 4 of the drawings. The brackets 50, which carry the leading edge clamping bar 46, are rotatable with the drum 24 at all times. The brackets 52, which carry the trailing edge clamping bar 48, are rotatable with the end caps 38 and 40 and, as such, may be held against rotation with the drum 24 when the bar 48 is spaced away from the drum periphery as in the retracted position thereof. Radial movement of the bars 46 and 48 away from the central axis is brought about by relative rotation of cams (not shown) carried by the shaft 26 and the brackets 50 and 52. Radial return movement of the bars to their respective sheet clamping positions is effected by springs (not shown) acting in the direction of the arrows 54 and 56 against axially extending tabs 58 and 60 on the brackets 50 and 52, respectively.

In FIG. 2, various relative positions of the drum 24 and clamping bars 46 and 48 are shown respectively in solid and phantom lines. As disclosed in the aforementioned copending Application and as depicted in FIG. 1, in the initial sheet loading orientation of the drum 24 and clamping bars 46 and 48, the drum is oriented so that the leading edge clamping bar 46, which rotates at all times with the drum, is at an approximate 6 o'clock position and is retracted away from the drum periphery as depicted by phantom lines in FIG. 2. The trailing edge clamping bar 48, which rotates with the end caps 38 and 40 independently of the drum when in the retracted position thereof, is oriented initially upstream from the leading edge clamping bar 46 in the context of sheet feed direction during loading or approximately at 7 o'clock and also retracted away from the drum periphery. Each sheet is loaded, therefore, by passage of the sheet leading edge over the retracted trailing edge clamping bar 48 to the retracted leading edge clamping bar 46. The leading edge clamping bar 46 is then closed against the leading edge of the sheet in the direction of the phantom line arrow 62 and the drum and leading edge clamping bar 46 are rotated through the angle represented by the arrow 63 to the solid line position of the leading edge clamping bar 46. During this rotation of the drum 24 and the closed leading edge clamping bar 46, the sheet S is pulled through the retracted trailing edge clamping bar 48 until the trailing edge of the sheet S underlies the bar 48. The trailing edge clamping bar 48 is then closed against the trailing edge of the sheet S and thereafter rotates with the drum 24 until the initiation of a cycle during which the sheet S is unloaded from the drum 24. The complete sheet loading and unloading operations are fully disclosed in the aforementioned copending Application and are not relevant to the present invention except to understand how the leading and trailing edge clamping bars 46 and 48 are moved to and from the solid line position of these members in FIG. 2. It is believed that this summary and the illustration in FIG. 2 supply an adequate basis for that understanding.

It will be seen in FIG. 2 that the sheet clamping bars 46 and 48 clamp the respective leading and trailing edges of the sheet S against the cylindrical periphery of the drum 24 on opposite side edges of the axial groove 42 and that the width of the groove 42 extends fully between the clamping bars 46 and 48. Also, inwardly directed flanges 64 and 66 on the respective clamping bars 46 and 48 are accommodated by the depth of the groove 42.

In accordance with the present invention, both clamping bars, shown fully in FIG. 4, are provided respectively with circumferentially extending tabs 68 and 70. As shown in FIG. 2, the tab 68 on the leading edge clamping bar 46 extends forwardly of the bar whereas the tab 70 on the trailing edge clamping bar 48 extends rearwardly of that bar. Also both tabs 68 and 70 are displaced radially inward of the sheet clamping portion of each of the bars 48. As a result of both of these characteristics, and also because the tabs 68 and 70 are axially offset relative to each other, both tabs 68 and 70 lie against the floor of the groove 42 when the clamping bars 46 and 48 are closed to retain a sheet S on the drum 24. This position of the tabs 68 and 70 and, more importantly, the clamping positions of the clamping bars 46 and 48 at the location of the tabs centrally of their length, is maintained against outward movement, due to centrifugal force acting on the bars during high speed rotation of the sheet loaded drum 24, by a retaining device generally designated by the reference numeral 72 in FIGS. 2–4.

The retaining device 72, as shown in FIGS. 2–4, is a self-contained unit capable of insertion into the drum 24 through an aperture 74 in the floor of the axial groove 42. The retaining device 72 includes a supporting block 76 upstanding from a base flange 78 capable of securement in the floor of the axial groove 42 by suitable means such as screws (not shown) or the like. The block 76, which projects within the drum 24 to an inner end short of the axis 25 thereof, is formed having oppositely extending spaced flanges 80 and 82 (FIG. 4) through which pivot pins 84 and 86 extend.

The pins 84 and 86 pivotally support respective bell crank retainers 88 and 90 between the respective flanges 80 and 82. The bell crank retainers 88 and 90 are of identical construction, each including mutually perpendicular arms 92 and 94 radiating from the pivot pins 84 and 86. A generally radially disposed arm 92 on each bell crank retainer extends through a slot 96 in the base flange 78 of the supporting block 76 to position a foot like claw 98 in the axial groove 42. The other arm 94 of each retainer 88 and 90 extends in a generally axial direction and supports a weight or mass 100 at the distal end thereof. A wire spring 102 exerts a biasing force between the block 76 and each of the retainers 88 and 90 and which tends to pivot the retainers to the phantom line position of the retainer 90 as shown in FIG. 3 of the drawings.

A combination of the configuration of the claws 98 and the location of the pivot pins 84 and 86 enables swinging movement of the claws 98 from a retracted position as shown in phantom lines in FIG. 3 to a retaining position in which the claws engage the outer surface of the tabs 68 and 70 fixed respectively to the leading and trailing edge clamping bars 46 and 48. Thus, it will be seen that the claws 98 are normally positioned in the retracted (phantom line) position and as such will enable movement of the clamping bars 46 and 48 relative to the drum as during sheet loading and unloading operations. When rotation of the drum develops centrifugal force of a sufficient magnitude to cause the weights 100 to overcome the bias of the springs 102 and pivot the bell crank retainers about the pins 84 and 86, the claws 98 will move into engagement with the outer surface of the tabs 68 and retain them firmly against the floor of the axial groove 42.

As a result of experimentation with a prototype model of a printing drum incorporating the present invention, it has been found that the illustrated retanning device is capable of operation such that at approximately 300 rpm, the claws 98 will move into engagement with the tabs 68 and 70. Because the force exerted by the weights 100 varies directly with centrifugal force, no separation of the central region of the clamping bars 46 and 48 occurs at speeds up to 1600 rpm.

Because the retaining device 72 represents an eccentric mass on the drum 24, a counterbalance weight 104 (FIG. 2) is mounted on the interior of the drum diametrically opposite from the location of the retaining device 72. The weight of the counterbalance 104 is selected to be approximately the same as the weight of the retaining device unit 72.

As above-mentioned, the brackets pairs 50 and 52 which support the clamping bars 46 and 48 at the respective opposite ends are radially biased by springs (not shown) to move the bars 46 and 48 to their respective clamping positions. At speeds on the order of 1600 rpm, the bars 46 and 48 represent a mass tending to overcome the spring bias under which they are retained against the leading and trailing edges of the sheet S. To ensure that the ends of the clamping bars also remain in their clamping position at high speeds in accordance with the present invention, the brackets 50 and 52 are fitted with counterbalancing weights 106 and 108 respectively. As may be seen in FIG. 4, the weights 106 and 108 are diametrically opposite from the bars 46 and 48 with the result that centrifugal force acting on the counterbalancing weights 106 and 108 will move the brackets to carry the ends of the clamping bars 46 and 48 firmly into the sheet clamping position by centrifugal force acting on the counterbalance weights 106 and 108.

Thus it will be seen that as a result of the present invention, a highly effective counterbalancing system for high speed sheet handling drums is provided and by which the stated objectives, among others, are completely fulfilled. It is contemplated that modifications and/or changes in the embodiment illustrated and described herein may be made without departure from the invention. Accordingly, it is expressly intended that the foregoing description and accompanying drawing illustrations are illustrative of a preferred embodiment only, not limiting, and that the true spirit and scope of the present invention be determined by reference to the appended claims.

What is claimed is:

1. In a sheet clamping system for rotatable drums, the system including a pair of clamping bars for releasably clamping leading and trailing edges of a sheet to the drum periphery, each of said pair of clamping bars extending for the axial length of the drum and being support at opposite ends for generally radial movement relative to the drum axis between sheet clamping and retracted positions the improvement comprising:

means for releasably retaining the central portion of each of said clamping bar pair in the respective sheet clamping positions thereof upon rotation of said drum at speeds causing centrifugal force to bow said bars outwardly from said sheet clamping positions, said releasable retaining means including centrifugal force responsive means biased to a retracted, non-retaining position and responsive to centrifugal force to move against the bias to a central clamping bar portion engaging and retaining position.

2. In a sheet clamping system for rotatable drums, the system including a pair of clamping bars for releasably clamping leading and trailing edges of a sheet to the drum periphery, each of said pair of clamping bars extending for the axial length of the drum and being supported at opposite ends for generally radial movement relative to the drum axis between sheet clamping and retracted positions, the improvement comprising:

means for releasably retaining the central portion of each of said clamping bar pair in the respective sheet clamping positions thereof upon rotation of said drum at speeds causing centrifugal force to bow said bars outwardly from said sheet clamping positions, wherein said means for releasably retaining the central portion of each clamping bar comprises pivotal means biased to a retracted, non-retaining position and means defining a mass subject to centrifugal force to move said pivotal means against the bias thereof to a clamping bar engaging and retaining position.

3. In a sheet clamping system for rotatable drums, the system including a pair of clamping bars for releasably clamping leading and trailing edges of a sheet to the drum periphery, each of said pair of clamping bars extending for the axial length of the drum and being supported at opposite ends for generally radial movement relative to the drum axis between sheet clamping and retracted positions, the improvement comprising:

means for releasably retaining the central portion of each of said clamping bar pair in the respective sheet clamping positions thereof upon rotation of said drum at speeds causing centrifugal force to bow said bars outwardly from said sheet clamping positions, wherein said means for releasably retaining the central portion of each clamping bar comprises a pivotal bell crank located within the drum and having a claw projecting from said drum to engage and retain said clamping bar.

4. The sheet clamping system recited in claim 3 wherein said bell crank comprises a pair of generally mutually perpendicular arms radiating from the pivotal support thereof, said claw being located at the end of one of said arms oriented in generally radial relation to the drum axis.

5. The sheet clamping system recited in claim 4 wherein the other of said arms carries a mass displaced from the pivotal support of said bell crank in a direction generally parallel to the drum axis.

6. The sheet clamping system recited in either of claims 3, 4 or 5 wherein said means for releasably retaining the central portion of each clamping bar comprises a support block extending radially within and secured to said drum, said bell cranks being supported from said support block for pivotal movement in a plane generally parallel to the drum axis.

7. The sheet clamping system recited in claim 6 wherein said drum is formed with an axial groove in the periphery thereof, said clamping bars being located on opposite sides of said axial groove in the sheet clamping position thereof, said claws projecting into said groove.

8. The sheet clamping system recited in claim 7 wherein said clamping bars include axially offset, circumferentially extending tabs for engagement by said claws.

9. A device for holding the central portion of elongated sheet clamping bars extending axially along the periphery of a high speed sheet handling drum and movable radially between a retracted position spaced from the drum periphery and a clamping position against the drum periphery, said device comprising:

a supporting block insertable radially into the interior of the drum to lie between the periphery and the rotational axis of the drum;

a pair of bell-crank retainers pivotally supported near the inner end of said block, each of said retainers including a pair of generally mutually perpendicular arms;

one of said arms on each retainer extending in a general radial direction and having a claw at the distal end thereof for engaging one of the respective clamping bars in the sheet clamping position thereof;

the other of said arms on each retainer extending in a generally axial direction and having a mass thereon displaced from the pivotal support of each retainer and movable under centrifugal force developed by drum rotation to cause said claw to engage and retain a respective one of clamping bars in the clamping position thereof.

10. The device recited in claim 9 including spring means for biasing said bell-crank retainers in a direction opposite to the direction of movement by centrifugal force.

11. A sheet handling drum for high speed printing apparatus having a print head in close proximity to the drum periphery, said drum comprising:

means for rotating the drum about the axis thereof;

a pair of clamping bars for releasably retaining the leading and trailing edges of a sheet against the drum periphery;

a pair of radially adjustable brackets for supporting opposite ends of each of said pair of clamping bars for movement between a retracted position spaced from the drum periphery and a clamping position against the drum periphery; and means for releasably retaining the central portion of each one of said pair of clamping bars in the respective sheet clamping positions thereof upon rotation of said drum at speeds causing centrifugal force to bow said bars outwardly from said sheet clamping positions, said releasable retaining means including centrifugal force responsive means biased to a retracted, non-retaining position and responsive to centrifugal force to move against the bias to a central clamping bar portion engaging and retaining position.

12. The sheet handling drum recited in claim 11 wherein said centrifugal force responsive means comprises a pair of movable weights located eccentrically of the drum axis, the drum further including a fixed counter-balancing weight located diametrically opposite from said movable weights.

13. The sheet handling drum recited in claim 11 including a weight on each of said brackets on the opposite side of the drum axis from said clamping bars, whereby said brackets are urged by centrifugal force during rotation of the drum in a direction to retain said clamping bars in the sheet clamping position thereof.

14. A sheet handling drum for high speed printing apparatus having a print head in close proximity to the drum periphery, said drum comprising:

means for rotating the drum about the axis thereof;

a pair of clamping bars for releasably retaining the leading and trailing edges of a sheet against the drum periphery;

a pair of radially adjustable brackets for supporting opposite ends of each of said pair of clamping bars for movement between a retracted position spaced from the drum periphery and a clamping position against the drum periphery; and means for releasably retaining the central portion of each one of said pair of clamping bars in the respective sheet clamping positions thereof upon rotation of said drum at speeds causing centrifugal force to bow said bars outwardly from said sheet clamping positions, wherein said means for releasably retaining the central portion of said clamping bars comprises a pair of pivotal bell cranks located within the drum and having claws projecting from said drum to engage and retain said clamping bars.

15. The sheet handling drum recited in claim 14 wherein the drum is former with an axial groove in the periphery thereof, said clamping bars being located on opposite sides of said axial groove in the clamping position thereof, said claws projecting into said groove.

16. The sheet handling drum recited in claim 15 wherein said clamping bars include axially offset, circumferentially extending tabs for engagement by said claws.

* * * * *